US006336740B1

(12) United States Patent
Keough

(10) Patent No.: US 6,336,740 B1
(45) Date of Patent: Jan. 8, 2002

(54) COVER ASSEMBLY WITH IMPROVED LOCKING FEET

(75) Inventor: James A. Keough, Howell, MI (US)

(73) Assignee: Dedoes Industries, Inc., Walled Lake, MI (US)

( * ) Notice: Subject to any disclaimer, the term of this patent is extended or adjusted under 35 U.S.C. 154(b) by 0 days.

(21) Appl. No.: 09/827,001

(22) Filed: Apr. 5, 2001

(51) Int. Cl.[7] ..... B01F 7/20; B01F 15/00

(52) U.S. Cl. ..... 366/247; 366/347; 366/605; 220/315; 220/326; 220/238

(58) Field of Search ..... 366/605, 247, 366/245, 249, 251, 252, 347; 220/315, 324, 326, 238

(56) References Cited

U.S. PATENT DOCUMENTS

| | | | | | |
|---|---|---|---|---|---|
| 2,585,334 A | * | 2/1952 | McCauley | ..... | 366/605 |
| 4,380,399 A | * | 4/1983 | Godat et al. | ..... | 366/605 |
| 5,368,389 A | * | 11/1994 | Dodes | ..... | 366/247 |
| 5,437,385 A | | 8/1995 | Fillon | ..... | 220/238 |
| 5,472,277 A | * | 12/1995 | Dedoes | ..... | 366/247 |
| 5,482,370 A | | 1/1996 | Dedoes | ..... | 366/247 |
| 5,503,474 A | * | 4/1996 | Krzywdziak | ..... | 366/605 |
| 5,603,426 A | * | 2/1997 | Krzywdziak et al. | ..... | 366/605 |

* cited by examiner

*Primary Examiner*—Tony G. Soohoo
(74) *Attorney, Agent, or Firm*—Gifford, Krass, Groh, Sprinkle, Anderson & Citkowski, P.C.

(57) ABSTRACT

A cover for a paint can for use with automatic paint stirring equipment is disclosed in which the paint can has a tubular cylindrical sidewall with an open top and a radially inwardly protruding chime around the open top of the can. The cover assembly includes a lid dimensioned to overlie the open top of the paint can and having a spout along its outer periphery. A paint stirrer is rotatably mounted to the lid and at least one locking foot removably secures the lid to the paint can. The locking device includes a stem pivotably mounted to the lid, a radially outwardly extending foot secured to one end of the stem and a handle secured to the opposite end of the stem. The stem is pivotal between a locked position in which the foot extends underneath the can chime, and an unlocked position in which the foot is spaced radially inwardly from the can chime. An axial and circumferentially extending slot forming a ramp surface is formed on the outer surface of the stem which cooperates with a protuding pin on the lid so that the foot is axially displaced away from the lid, and thus downwardly and away from the can chime, as the locking device is moved from its locked position to its unlocked position.

8 Claims, 3 Drawing Sheets

COVER ASSEMBLY WITH IMPROVED LOCKING FEET

BACKGROUND OF THE INVENTION

I. Field of the Invention

The present invention relates generally to cover assemblies for use with automated paint stirring equipment and, more particularly, to such a cover assembly with improved locking feet.

II. Description of Related Art

There are many previously known cover assemblies which are particularly designed for use with automated paint stirring equipment. These cover assemblies typically comprise a lid dimensioned to overlie an open top of a paint can. The paint can, in turn, includes a radially inwardly extending chime formed around its open top.

These previously known cover assemblies typically comprise a spout formed along the outer periphery of the paint can lid and a handle attached to the lid and diametrically opposed from the spout. A paint stirrer is then rotatably mounted to the lid so that, with the lid disposed over the open top of the paint can, the stirrer is positioned within the interior of the paint can.

In order to secure the cover assembly to the paint can, the previously known cover assemblies typically include at least two, and oftentimes more, locking devices. Each locking device, furthermore, typically comprises a cylindrical stem which is pivotally mounted to the lid and movable between a locked and unlocked position. A locking foot is secured to the end of the stem while a handle is secured to the opposite or upper end of the stem.

With the locking device in its locked position, the stem is pivoted so that the locking foot moves underneath the can chime. Furthermore, a compression spring is typically disposed between the lid and the handle and this spring urges the locking foot towards the lid thus compressibly sandwiching the can chime in between the lid and the locking foot.

Conversely, in its unlocked position, the locking foot is pivoted so that the entire locking foot is spaced radially inwardly from the can chime. In this position, the cover assembly can be freely removed from or positioned over the paint can. Furthermore, a resilient seal is conventionally sandwiched in between the paint can chime and the lid in order to fluidly seal the bottom of the lid to the paint can.

One disadvantage of these previously known cover assemblies, however, is that, since the spring urges the locking feet against the bottom of the paint can chime, rotation of the locking feet between their locked and unlocked position causes the locking feet to scrape along the bottom of the chime. This, in turn, can abrade the protective coating found on the interior of paint cans. When the protective coating is abraded, oxidation of the paint can can occur which can cause contamination of the paint within the can.

SUMMARY OF THE PRESENT INVENTION

The present invention provides a cover assembly for a paint can of the type used with automated paint stirring equipment which overcomes all of the above-mentioned disadvantages of the previously known devices.

In brief, the cover assembly of the present invention comprises a lid which is dimensioned to overlie the open top of a paint can. In the conventional fashion, the paint can includes a radially inwardly projecting chime around its open top. The paint can lid includes a spout at its outer periphery as well as a handle secured to the lid and diametrically opposed from the spout. A paint stirrer is rotatably mounted to the lid so that, with the lid positioned over the open top of the paint can, the stirrer is positioned within the interior of the paint can.

At least one, and more typically two or more locking devices are provided for removably securing the lid to the paint can when the lid is positioned over the open top of the paint can. Each locking device includes a stem which is pivotally mounted to the lid and pivotal between a locked position and an unlocked position. A radially outwardly extending locking foot is secured to the lower end of the stem while a handle is secured to the opposite or upper end of the stem for moving the stem with its attached locking foot between the locked and unlocked position. A compression spring is also sandwiched in between the handle and the lid which urges the stem upwardly towards its locked position.

In its locked position, the locking foot protrudes underneath the can chime so that the chime is compressed in between the locking foot and a lower side of the paint can lid. An annular resilient seal is disposed around the outer periphery on the bottom of the paint can lid which sealingly engages the top of the paint can.

Conversely, when the handle rotates the stem from its locked position to its unlocked position, the locking feet are pivoted so that the locking feet are spaced radially inwardly from the chime. With the locking feet in the unlocked position, the paint can cover may be easily disposed over or removed from the paint can.

Unlike the previously known cover assemblies, however, a circumferentially and annularly extending groove is provided in the outer periphery of the locking device stem which, in turn, forms an axially and circumferentially extending ramp surface along the stem. Additionally, a pin attached to the paint can lid protrudes inwardly into the stem groove and abuts against the ramp surface. Consequently, rotation of the locking device stem from its locked position and to its unlocked position axially displaces the locking foot downwardly away from the paint can chime due to the mechanical interaction between the pin and the ramp surface. This axial displacement thus minimizes the amount of abrasion which occurs between the locking feet and paint can chime as the locking device stem is pivoted thus minimizing the possibility of damaging the protective coating on the paint can chime.

BRIEF DESCRIPTION OF THE DRAWING

The present invention will be better understood upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
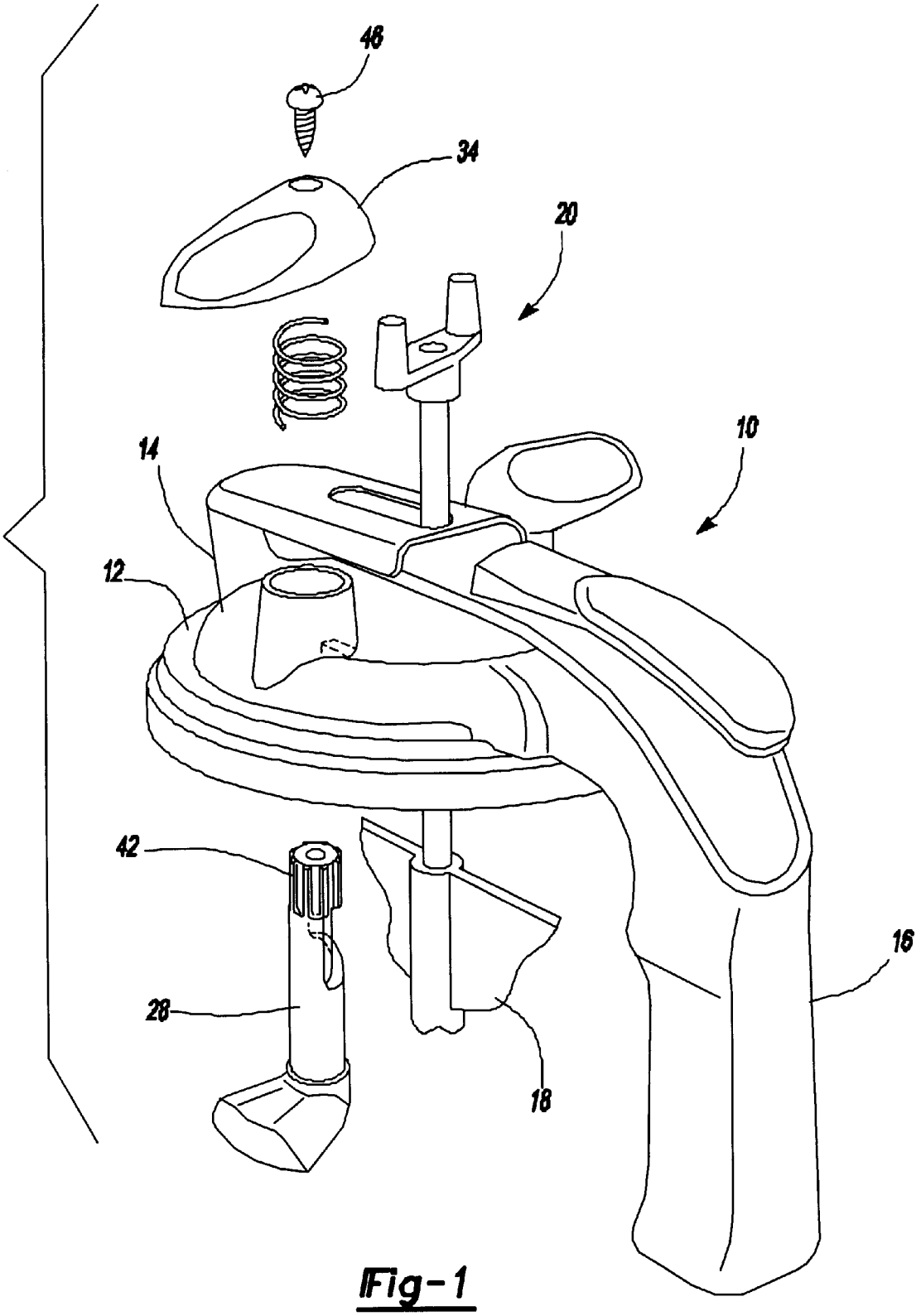
FIG. 1 is an exploded elevational view illustrating a preferred embodiment of the present invention.
Figure 2:
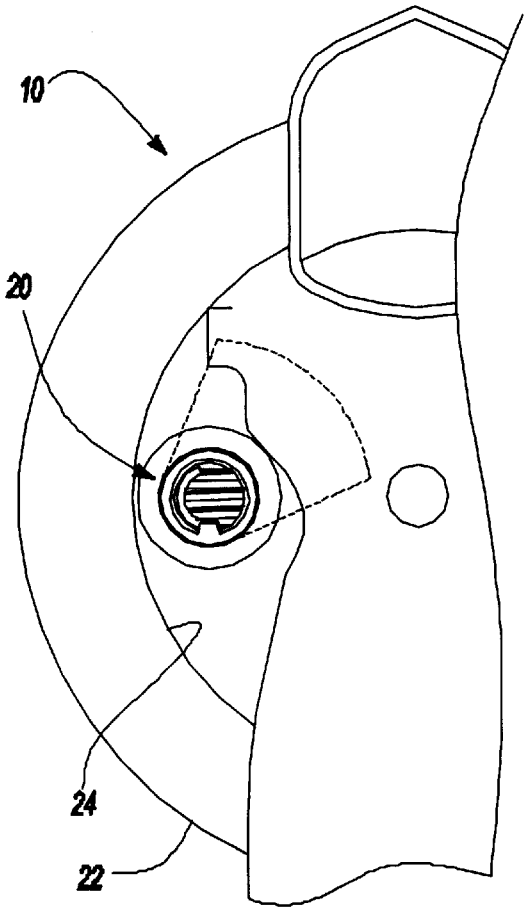
FIG. 2 is a fragmentary top plan view illustrating the locking device in an unlocked position.
Figure 3:
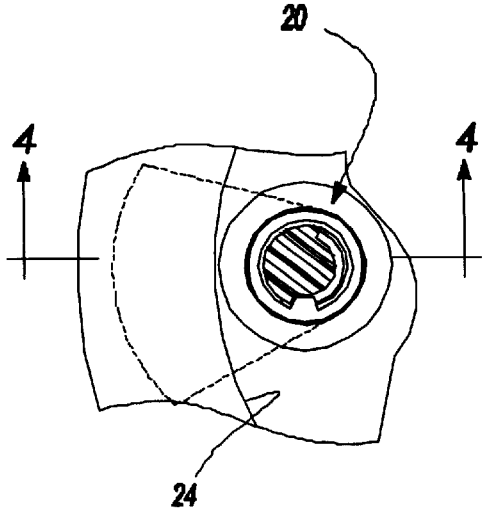
FIG. 3 is a view similar to FIG. 2 but illustrating the locking device in a locked position.

With reference first to FIG. 1, a cover assembly 10 of the present invention for use with automatic paint stirring equipment is shown having a generally circular lid 12. The cover assembly 10 includes a spout 14 formed along the outer periphery of the lid 12 as well as a handle 16 secured to the lid 12 and generally diametrically opposed from the spout 14. A paint stirrer 18 is also rotatably mounted to the lid 12 in the conventional fashion.

Figure 4:
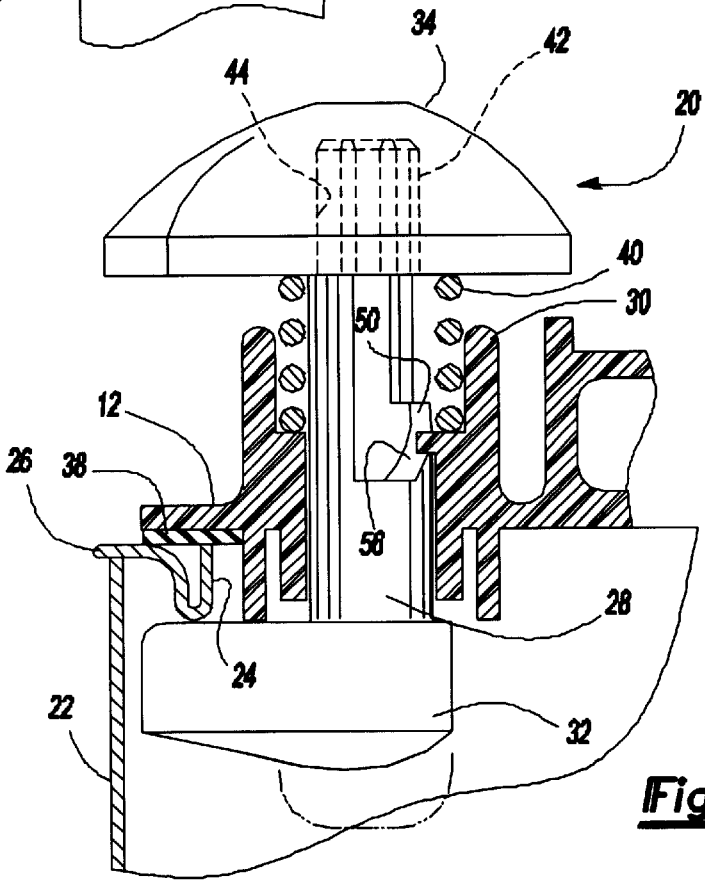
FIG. 4 is a view taken substantially along line 4—4 in FIG. 3.
Figure 5:
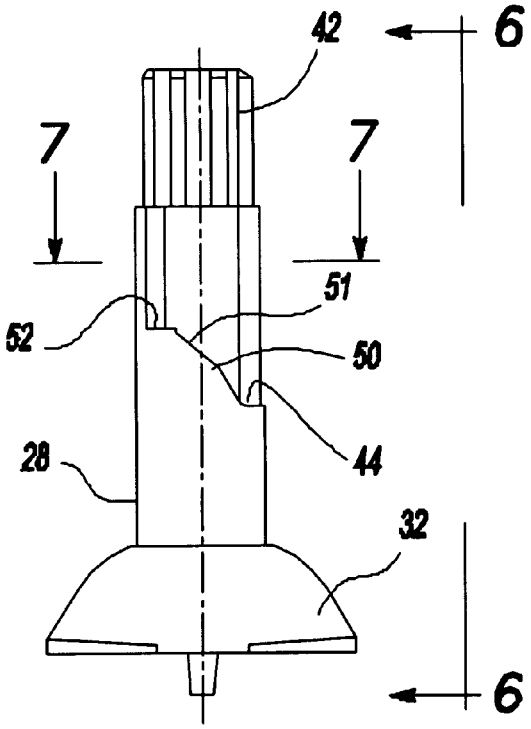
FIG. 5 is a plan view illustrating a portion of the locking device.
Figure 6:
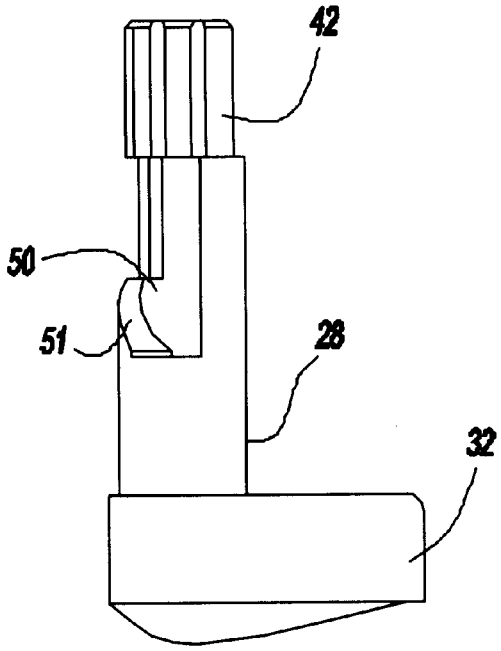
FIG. 6 is a view taken along line 6—6 in FIG. 5.
Figure 7:
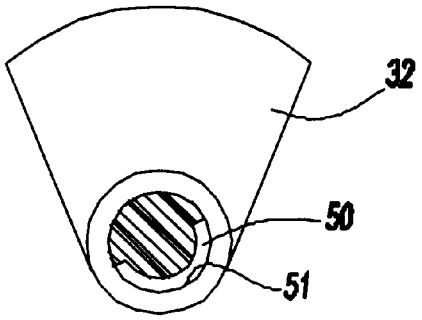
FIG. 7 is a view taken along line 7—7 in FIG. 5.

With reference now to FIGS. 1–4, at least one, and preferably two or more locking devices 20 are provided to detachably secure the lid 12 to a paint can 22 when the lid 12 is positioned over an open top 24 of the paint can 22 as shown in FIG. 4. Furthermore, in the conventional fashion, the paint can 22 includes a radially inwardly projecting chime 26 around its open top 24.

With reference now particularly to FIG. 4, the locking device 20 includes an elongated stem 28 which is pivotally mounted to a generally tubular and cylindrical boss 30 formed on the paint can lid 12. A locking foot 32 is secured to the lower end of the stem 28 so that the locking foot 32 extends radially outwardly from the pivotal axis of the stem 28. Furthermore, a handle 34 is secured to the opposite or upper end of the stem 28 and the handle 34 is used to pivot the stem 28 with its attached locking foot 32. Preferably a splined coupling is formed between the handle 34 and stem 28 to lock them together.

With reference again to FIGS. 2–4, the handle 34 pivots the stem 28 with its attached locking foot 32 between a locked position, illustrated in FIGS. 3 and 4, and an unlocked position, illustrated in FIG. 2. In its locked position, a portion of the locking foot 32 extends under the can chime 26 so that the can chime 26 is sandwiched in between the locking foot 32 and the can lid 12. Conversely, rotation of the stem 28 with its attached locking foot 32 by the handle 34 to its unlocked position, illustrated in FIG. 2, moves the locking foot 32 so that the locking foot 32 is spaced radially inwardly from the chime 26. With the locking foot 32 in the unlocked position, the cover assembly 10 can be freely removed from the paint can 22 or placed over a new paint can 22.

With reference again to FIG. 4, a compression spring 40 in a state of compression is sandwiched in between the lid boss 30 and the handle 34 so that the spring 40 resiliently urges the locking foot 32 towards the lid 12. In doing so, the can chime 26 is compressibly sandwiched in between the lid 12 and locking foot 32. Furthermore, a resilient seal 38 is preferably sandwiched in between the chime 26 and the lid 12 in order to provide a fluid seal between the lid 12 and chime 26.

With reference now to FIGS. 1 and 4, any conventional means can be used to secure the handle 34 to the stem 28. However, in the preferred embodiment of the invention, the upper end of the stem 28 includes circumferentially spaced splines 42 which mesh with a splined recess 34 (FIG. 4) formed in the handle 34. A fastener, such as a screw 46 (FIG. 1), then secures the handle 34 to the stem 28 so that the handle 34 and stem 28 move in unison with each other.

With reference now to FIGS. 4–7, a circumferentially and axially extending groove 50 forming a circumferentially and axially extending ramp surface 51 is provided along an intermediate section of the stem 28. A flat 52 is formed at the end of the ramp surface 51 closest to the stem spline 42 for a reason to be subsequently described. Similarly, a flat 44 is also preferably formed at the opposite end of the ramp surface 51.

With reference now to FIG. 4, a pin 56 is secured to or formed as a part of the boss 30 so that the pin 56 protrudes into the groove 50 on the stem 28. Furthermore, the compression spring 40 ensures that the pin 56 remains in contact with the ramp surface 51 regardless of the pivotal position of the stem 28.

In practice, the mechanical interaction between the pin 56 and the ramp surface 51 axially displaces the stem 28, and thus the locking foot 32, downwardly away from the can chime 26 as the stem 28 is pivoted from its locked position, illustrated in solid line in FIG. 4, and to its unlocked position, illustrated in phantom line in FIG. 4. In doing so, abrasion between the locking foot 32 and the can chime 26 is minimized as the locking device 20 is moved between its locked position and unlocked position.

In the preferred embodiment of the invention, the cover assembly lid 12, boss 30 and pin 56 are all of a one-piece plastic construction for inexpensive cost yet durable operation.

From the foregoing, it can be seen that the present invention provides a simple and yet effective cover assembly for use with automated paint stirring equipment which minimizes the abrasion between the locking feet and the paint can chime as the locking feet are moved between the locked and unlocked position. Having described my invention, however, many modifications thereto will become apparent to those skilled in the art to which it pertains without deviation from the spirit of the invention as defined by the scope of the appended claims.

I claim:

1. A cover assembly for a paint can for use with automatic stirring equipment, the paint can having a tubular cylindrical sidewall, an open top and a radially inwardly protruding chime around said open top, said cover assembly comprising:

a lid dimensioned to overlie the open top of the paint can, said lid having a spout, paint stirring means rotatably secured to said lid, at least one locking device which removably secures said lid to the paint can when said lid overlies the open top of the paint can, said locking device having a stem pivotally mounted to said lid, a radially outwardly extending foot secured to one end of said stem and a handle secured to the opposite end of said stem, said stem being pivotal between a locked position in which said foot extends underneath the can chime and an unlocked position in which said foot is spaced radially inwardly from the can chime, and means for axially moving said foot away from said lid as said stem pivots from said locked position to said unlocked position.

2. The invention as defined in claim 1 and comprising a spring which urges said stem towards said locked position.

3. The invention as defined in claim 1 wherein said stem extends through a boss on said lid and wherein said axial moving means comprises an axially and circumferentially extending groove formed on an outer surface of said stem, said groove forming an axially and circumferentially extending ramp surface, and an inwardly protruding pin on said boss which extends into said groove and abuts against said ramp surface.

4. The invention as defined in claim 3 wherein said ramp surface includes a flat at least one end.

5. The invention as defined in claim 3 wherein said ramp surface includes a flat at both ends.

6. The invention as defined in claim 3 wherein said lid, said boss and said pin are of a one-piece construction.

7. The invention as defined in claim 6 wherein said lid, said boss and said pin are of a one-piece plastic construction.

8. The invention as defined in claim 2 and comprising a handle secured to the other end of said stem, wherein said spring comprises a compression spring sandwiched in a state of compression between said lid and said handle.

* * * * *